United States Patent [19]

Gandy

[11] 4,380,880

[45] Apr. 26, 1983

[54] ILLUMINATED SIGN ASSEMBLY

[75] Inventor: James Gandy, Mississauga, Canada

[73] Assignee: Signtech Inc., Mississauga, Canada

[21] Appl. No.: 301,491

[22] Filed: Sep. 14, 1981

[51] Int. Cl.[3] ..... G09F 13/04

[52] U.S. Cl. ..... 40/564; 40/152.2

[58] Field of Search ..... 40/564, 607, 606, 152.2

[56] References Cited

U.S. PATENT DOCUMENTS

| | | | |
|---|---|---|---|
| 3,893,251 | 7/1975 | Coleman | 40/607 |
| 4,007,552 | 2/1977 | Brooks | 40/606 |
| 4,205,471 | 6/1980 | Coleman | 40/607 |

FOREIGN PATENT DOCUMENTS

| | | | |
|---|---|---|---|
| 909506 | 9/1972 | Canada | 40/564 |

*Primary Examiner*—Gene Mancene
*Assistant Examiner*—Wenceslao J. Contreras
*Attorney, Agent, or Firm*—Robert F. Delbridge; Arne I. Fors

[57] ABSTRACT

An illuminated sign assembly has a casing with a wall extending downwardly from the top, the top having a substantially horizontal shelf and a downwardly extending lip below the shelf, and the wall having a flange with a free end portion resting on the shelf. A hinge member has a generally U-shaped section with upwardly extending spaced arms connected by a bight, the bight being located below the downwardly extending lip of the top with one arm extending upwardly on one side of the lip below the flange. The flange is detachably secured to one arm of the hinge member, and the other arm of the hinge member extends upwardly on the opposite side of the lip to the one arm to retain the wall in assembly with the top while permitting limited upward pivotal movement of the wall relative to the top by pivoting of the free end of the flange on the shelf.

2 Claims, 5 Drawing Figures

ILLUMINATED SIGN ASSEMBLY

This invention relates to illuminated sign assemblies which comprise a casing having at least one wall of translucent material and carrying a worded and/or pictorial message, with illuminating means being located within the casing.

One wall is usually hinged to the remainder of the casing to provide access to the interior of the casing when necessary, for example to repair or replace a component of the illuminating means. One hinge arrangement is described in U.S. Pat. No. 4,267,657 issued May 19, 1981. However, with this known hinge, the hinged wall is removable from the remainder of the casing by continued pivotal movement in the opening direction and in some installations this is not desirable.

It is therefore an object of the invention to provide an illuminated sign assembly having a hinged wall which is simple to install and remove but which is not removable merely by pivotal movement.

According to the present invention, an illuminated sign assembly comprises a casing having a top, a wall extending downwardly from the top, the top having a substantially horizontal shelf and a downwardly extending lip below the shelf, the wall having a flange with a free end portion resting on the shelf, a hinge member having a generally U-shaped section with upwardly extending spaced arms connected by a bight, the bight being located below the downwardly extending lip of the top with one arm extending upwardly on one side of the lip below the flange, means detachably securing the flange to said one arm of the hinge member, and the other arm of the hinge member extending upwardly on the opposite side of the lip to the said one arm to retain the wall in assembly with the top while permitting limited upward pivotal movement of the wall relative to the top by pivoting of the free end of the flange on the shelf.

Thus, the wall is retained in engagement with the top by the hinge member, although the wall can easily be attached to or removed from the top by installing or removing the detachable securing means.

Advantageously, the flange of the wall, the shelf and lip of the top and the hinge member are extrusions and the detachable securing means comprise screws passing through the flange into the said one arm of the hinge member.

Figure 1:
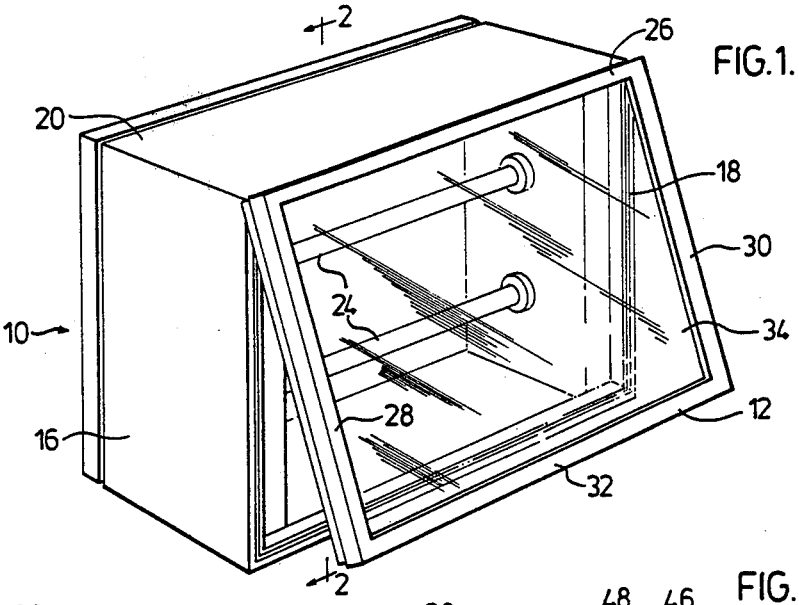
Figure 2:
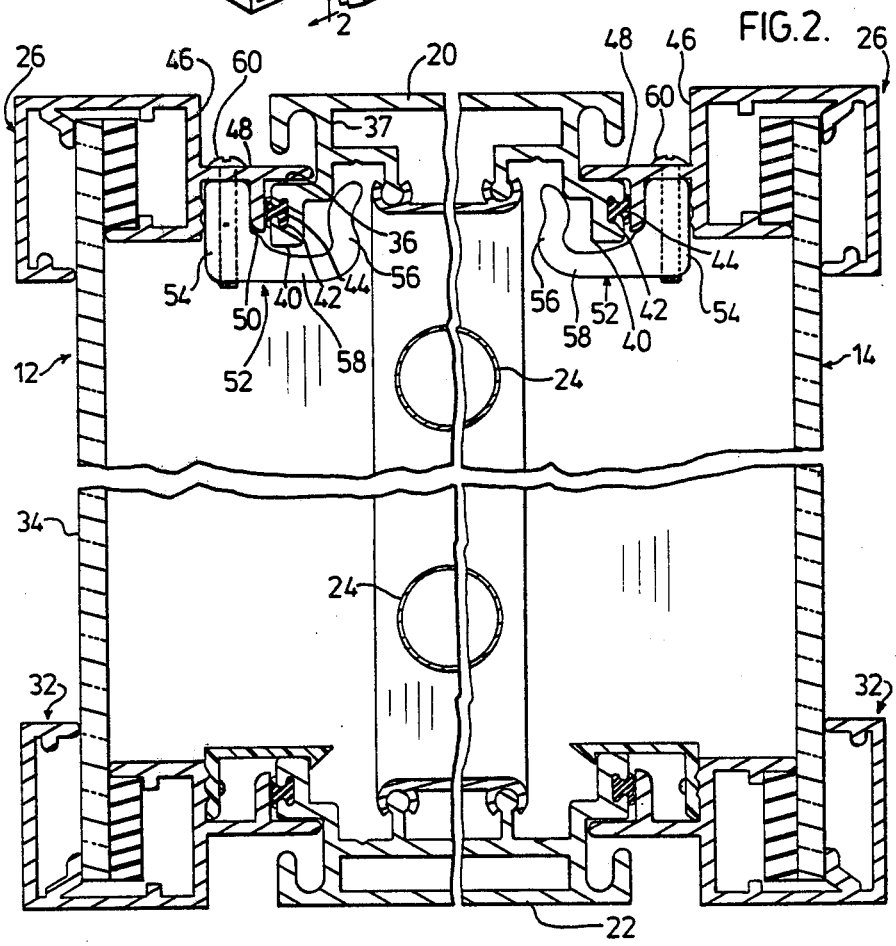
Figure 3:
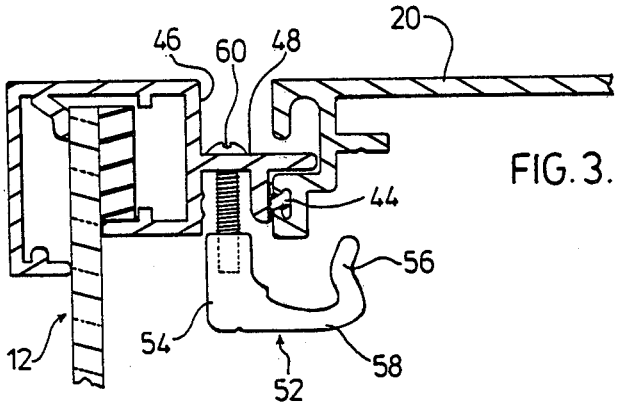
Figure 4:
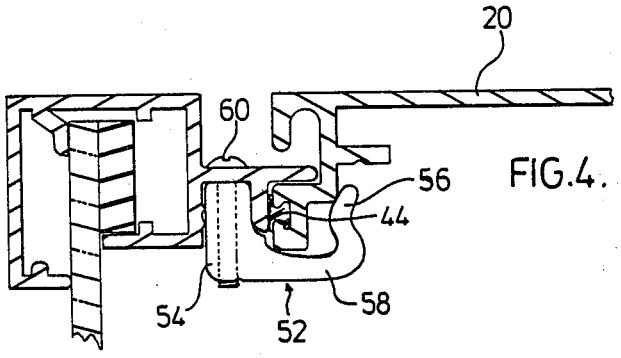
Figure 5:
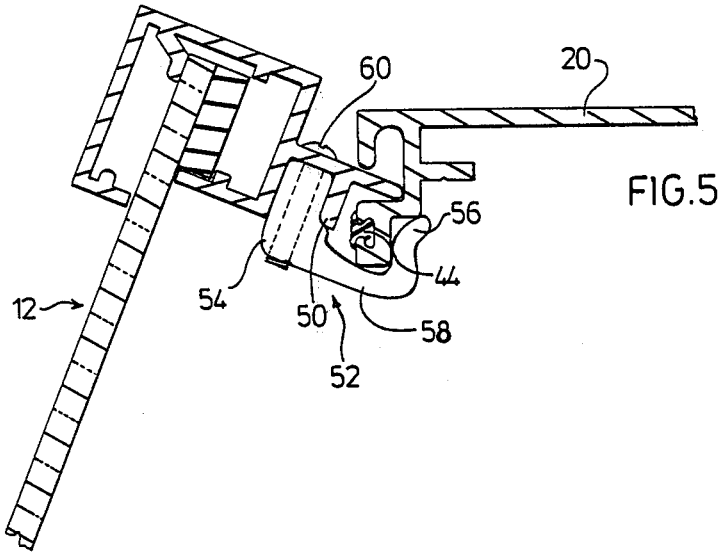

One embodiment of the invention will now be described, by way of example, with reference to the accompanying drawings, of which:

FIG. 1 is a perspective view of an illuminated sign assembly with the front wall in an open position pivoted away from the remainder of the casing, FIG. 2 is a sectional view along the line 2—2 of FIG. 1, but showing the front wall in the closed position, FIG. 3 is a detail view showing how the front wall is assembled with the remainder of the casing, FIG. 4 is a similar view showing the assembly completed with the front wall in the closed position, and FIG. 5 is a similar view showing the front wall pivoted to an open position away from the remainder of the casing.

Referring to the drawings, an illuminated sign assembly comprises a casing 10 with a hinged front wall 12, a hinged rear wall 14, side walls 16, 18, a top 20 and a bottom 22, all of which are aluminum extrusions. With the exception of the manner in which the front wall 12 and rear wall 14 are hinged to the top 20, the sign assembly is similar in construction to that described in previously mentioned U.S. Pat. No. 4,267,657 and hence will not be described in detail in this application. The casing 10 contains a pair of fluorescent tubes 24 to enable the sign assembly to be illuminated from within. The front wall and rear wall 14 are hinged to the top 20 in a similar manner in accordance with the invention, and therefore only the manner in which the front wall 12 is hinged to the top 22 will be described in detail.

The front wall 12 has a frame formed by four extruded aluminum frame members, namely an upper member 26, side members 28, 30 and a bottom member 32. A translucent panel 34 carrying a worded and/or pictorial message is mounted in the frame in the manner described in U.S. Pat. No. 4,267,657.

The top 20 has a horizontal outwardly extending shelf 36 adjacent the front wall 12, the shelf 36 extending forwardly from a vertical web 37 of the top extrusion 22. The top 20 also has a lip 40 extending downwardly from the shelf 36, the lip 40 having a T-shaped groove 42 in its front face in which a sealing strip 44 is mounted.

The upper frame member 26 has a vertical rear portion 46 from which a flange 48 projects rearwardly, with the free end portion of the flange 48 resting on the shelf 36 of the top 20. A short skirt 50 extends downwardly from the flange 48 partway along its length and, in the closed position of the front wall 12, the skirt 50 engages the sealing strip 44.

A U-shaped hinge member 52 has two upwardly extending arms 54, 56 connected by a bight 58. When assembled with the upper frame member 26 and top 22, as shown in FIG. 2, the bight 58 extends beneath the lip 40 of the top 22, with the arm 54 extending upwardly between the rear portion 46 and the skirt 50 of the upper frame member 26, and the arm 56 extending upwardly behind the lip 40 of the top 22. A series of screws 60 spaced along the length of the upper frame member 26 extend through the flange 48 into threaded bores (not shown) in the arm 48 of the hinge member 52.

To attach the front wall 12 to the remainder of the casing 10, the hinge member 52 is first loosely attached to the upper frame member 56 by screws 60, as indicated in FIG. 3, and the flange 48 of the upper frame member 26 is positioned on the shelf 36 of the top 22. The screws 60 are then tightened, as shown in FIG. 4, to position the arm 54 of the hinge member 52 between the rear portion 46 and the skirt 50 of the upper frame member 26, and to position the arm 56 behind the lip 40 of the top 22, with the bight 58 of the hinge member 52 extending beneath the lip 40. The upper frame member 26 is therefore retained in engagement with the top 22 of the casing 10.

If it is desired to gain access to the interior of the casing 10, the front wall 12 can readily be opened by pivoting movement relative to the top 22 of the casing 10, as shown in FIG. 5, with the free end of the flange 48 of the upper frame member 26 pivoting on the shelf 36 of the top 22 at the junction of the shelf 36 and the vertical web 37. The opening movement of the front wall 12 is limited by engagement of the arm 56 of the hinge member 52 with the rear of the lip 40 of the top 22, as indicated in FIG. 5.

The front wall 12 of the described illuminated sign assembly can thus be easily positively attached to the remainder of the casing 10 in a manner which permits sufficient pivotal movement of the front wall 12 relative to the remainder of the casing 10 to enable access to the interior of the casing 10 to be obtained.

Other embodiments of the invention will be readily apparent to a person skilled in the art, the scope of the invention being defined in the appended claims.

What I claim as new and desire to protect by Letters Patent of the United States is:

1. An illuminated sign assembly comprising a casing having a top, a wall extending downwardly from the top, the top having a substantially horizontal shelf and a downwardly extending lip below the shelf, the wall having a flange with a free end portion resting on the shelf, a hinge member having a generally U-shaped section with upwardly extending spaced arms connected by a bight, the bight being located below the downwardly extending lip of the top with one arm extending upwardly on one side of the lip below the flange, means detachably securing the flange to said one arm of the hinge member, and the other arm of the hinge member extending upwardly on the opposite side of the lip to the said one arm to retain the wall in assembly with the top while permitting limited upward pivotal movement of the wall relative to the top by pivoting of the free end of the flange on the shelf.

2. An illuminated sign assembly according to claim 1 wherein the flange, the shelf and lip of the top and the hinge member are extrusions, and the means detachably securing the flange to the said one arm of the hinge member comprise screws passing through the flange into the said one arm.

* * * * *